United States Patent [19]

Kuehnle et al.

[11] Patent Number: 4,510,223

[45] Date of Patent: Apr. 9, 1985

[54] MULTICOLOR ELECTROPHOTOGRAPHIC IMAGING PROCESS

[75] Inventors: Manfred R. Kuehnle, New London, N.H.; Ferdinand Martinez, Belmont, Mass.; I. V. Runyan, Bedford, Mass.; Carol M. F. Barry, Maynard, Mass.

[73] Assignee: Coulter Systems Corporation, Bedford, Mass.

[21] Appl. No.: 498,825

[22] Filed: May 27, 1983

Related U.S. Application Data

[63] Continuation-in-part of Ser. No. 464,671, Feb. 7, 1983, abandoned.

[51] Int. Cl.[3] ..... G03G 13/01

[52] U.S. Cl. ..... 430/44; 430/42; 430/45; 430/47

[58] Field of Search ..... 430/42, 45, 47, 44

[56] References Cited

U.S. PATENT DOCUMENTS

| | | | |
|---|---|---|---|
| 3,057,720 | 10/1962 | Hayford et al. | 430/45 |
| 3,060,020 | 10/1962 | Greig | 430/42 |
| 3,376,133 | 4/1968 | Roteman | 430/45 |
| 3,702,483 | 11/1972 | Fantuzzo | 430/45 |
| 3,904,406 | 9/1975 | Takahashi | 430/47 |
| 3,928,033 | 12/1975 | Anzai | 430/42 |
| 4,176,940 | 12/1979 | Katakabe et al. | 430/42 |
| 4,281,051 | 7/1981 | Sakai | 430/45 |

FOREIGN PATENT DOCUMENTS

| | | | |
|---|---|---|---|
| 42975 | 12/1973 | Japan | 430/47 |

*Primary Examiner*—Mary F. Downey

*Attorney, Agent, or Firm*—Silverman, Cass & Singer, Ltd.

[57] ABSTRACT

A method of electrophotographic color reproduction by forming sequentially superimposed toner images of each color successively on the photoconductive surface of an electrophotographic recording member. The photoconductive surface is charged uniformly by a corona generator to a predetermined charge level. The charged surface is exposed to a first color radiation pattern from a source thereof to form a latent electrostatic charge image on said surface. The resulting latent charge image is toned with one color toner to produce a first toner image. The resulting toner image is dried. Thereafter, a charge is applied uniformly to the same photoconductive surface including those portions thereof carrying the dried first toner image in a manner so that the generated charged ions effectively tunnel through the dry adjacent toner particles defining first toner image to reach the photoconductive surface. The resulting charge potential is uniformly distributed over the entire photoconductor surface, including the toned and untoned areas thereof.

Thereafter, the entire charged surface is exposed to a second radiation color pattern from a source thereof, the radiation penetrating the first toner image to produce a second latent electrostatic charge image on said overall surface. Toning is effected with a second color toner to define a second toned color toner image superimposed in proper registry. The second toner image is dried and the aforementioned steps are repeated until the desired number of color toner images superimposed one upon the other are completed to form a desired composite color toner image. The complete image is transferred to an image receptor in a single transfer step to achieve the desired print reproduction.

6 Claims, 6 Drawing Figures

1.
2.
3.
4.
5.
6.
7.
8.
9.

26
28
30
24
42
54
38
40
46
34
68
80
81
86
60

MULTICOLOR ELECTROPHOTOGRAPHIC IMAGING PROCESS

REFERENCE TO RELATED PATENTS AND PATENT APPLICATIONS

This application is a Continuation-In-Part of pending application Ser. No. 464,671 filed Feb. 7, 1983, now abandoned entitled MULTICOLOR ELECTROPHOTOGRAPHIC IMAGING PROCESS by the inventors hereof.

Reference is made to each of the following patents and patent applications for the disclosures thereof in respect of the electrophotographic imaging apparatus and recording member described therein, the same being incorporated by reference herein as a part hereof.

(1) U.S. Pat. No. 4,025,339 granted May 24, 1977 for ELECTROPHOTOGRAPHIC FILM, METHOD MAKING AND USING THE SAME AND PHOTOCONDUCTIVE COATING USED THEREWITH.

(2) U.S. Pat. No. 4,269,919 granted May 26, 1981 for PHOTOCONDUCTIVE COATING, ELECTROPHOTOGRAPHIC MEMBER AND METHOD OF MAKING SAME.

(3) U.S. Pat. No. 4,358,195 granted Nov. 9, 1982 for ELECTROPHOTOGRAPHIC COLOR PROOFING APPARATUS.

(4) U.S. patent application Ser. No. 348,769 filed Feb. 16, 1982 for ELECTROPHOTOGRAPHIC IMAGING APPARATUS AND METHOD PARTICULARLY FOR COLOR PROOFING.

(5) U.S. patent application Ser. No. 454,480 filed Dec. 29, 1982, for ELECTROPHOTOGRAPH IMAGE APPARATUS AND METHOD PARTICULARLY FOR COLOR PROOFING.

(6) U.S. patent application Ser. No. 423,014 filed Sept. 24, 1982 for OPAQUE CONTACT PRINT COPY AND METHOD OF MAKING SAME.

These patents and applications are owned by the same assignee as that of the herein application.

BACKGROUND OF THE INVENTION

This invention relates generally to electrophotographic imaging and more particularly provides a method and apparatus for producing color reproductions from color separated images wherein the color reproductions comprise sequentially applied superimposed toned latent images successively produced on a single electrophotographic member in registry and transferred simultaneously to a receptor in a single step.

The invention herein is applicable generally for forming color reproductions. However, it is useful particularly to produce color proof prints for the printing industry.

Color proofs are employed to enable the printing craftsman to ascertain quickly, efficiently and accurately the results of color separation, the corrections required to be made to the color separation and the suitability of the corrected color separations for platemaking. The ability to simulate and/or to predict the final appearance of the ultimate print copy on the particular receptor medium used for the print run is an important factor in the color printing process.

Separation proofs are made directly of the photoreproduction apparatus to determine the results of the separation process and the identity and character of any corrections needed. Of considerable importance is the capability of accurate and reproducible evaluation of factors such as color balance, tone reproduction, shadow detail, image sharpness, and contrast, among others. Economy and speed in making such proofs are sought after goals in color proofing. Equally important are reliability, reproducibility and predictability. The proof must reproduce the color separation film exactly without distortion or loss. Exact replicas of the printing ink characteristics should be reproduced so that overprinting colors will be the same on the proofs as they are with printing inks employed on the printed sheet.

The pre-press proof is intended to reproduce the result which will be obtained using the printing press, indiciating the effects of the paper surface, ink strength, gloss, etc. The pre-press proof should show the same printing characteristics as the finished printed result.

Several photomechanical processes for prepress-proofing are available. These systems fall into two catagories, namely overlay systems and superimposition systems.

Overlay systems consist of a set of transparent light sensitive films which are dried or pigmented to simulate the four process colors, yellow, cyan, black and magenta. Each screened separation is exposed to the appropriate film and developed chemically. After development, four separate images are produced which are superimposed in register. The result is viewed as a transparency. These are generally employed where a quick and inexpensive proof is required and normally are not a satisfactory match for the printed reproduction. The whites are gray and the result, very glossy, suffering from internal reflections between film layers which generally cause color changes in overprinted colors. They are economical to produce, require no special equipment and are extensively used for internal checking.

Superimposition systems involve the production of an image on an integral backing sheet either specific to the process or of the type on which the final print will be made. These processes include the Cromalin process of DuPont Co., the Transfer Key process of Minnesota Mining and Manufacturing Corporation, the Gevaproof process of Agfa-Gevaert and the Remak process of Chemical Corporation of Australia, Pty. Ltd.

The Cromalin process involves the lamination of a tacky transparent photopolymer film to a base sheet under heat and pressure. The film is hardened by exposure to ultraviolet light. The protective cover sheet is removed and toning powder of the appropriate color is dusted over the surface. The toner adheres only to the areas where no exposure has been received and the polymer remains tacky. The proof is produced by repeating this procedure four times, once for each separation. The base material is a heavy cast coated paper or a boardlike member, thus requiring specially made stock.

The Transfer Key process can employ any base stock. A set of four transparent light sensitive films are applied which have been pigmented to simulate the four process colors. These films are coated with a pressure sensitive adhesive and may be adhered to a base stock to form the laminate. The exposed image is polymerized by exposure to ultraviolet light. The unhardened areas are removed by a solvent with the proof being built up one layer at a time. This process can be improved by producing the layers on a transparent base which in turn is laminated to a base sheet using a spacer to simulate dot gain.

The Gevaproof process also uses laminations to a base stock similar to the Transfer Key process.

The REMAK process is an electrostatic process wherein a sheet of paper coated with a zinc oxide/resin binder composition is charged electrostatically and exposed to light through a color separated transparency. The exposed sheet is immersed in a liquid toner bath and electrophoretically toned. The resulting visible image is transferred to any base stock or, alternatively, the proof may be built up by successive exposures and toning on the original base material. Unfortunately, the zinc oxide photoconductor used with the REMAK process is extremely sensitive to changes in temperature and relative humidity, as well as variations in toner lots.

Many of the problems of prior art proofing methods have been solved by the referenced U.S. Pat. No. 4,358,195 granted Nov. 9, 1982. The referenced patent discloses a method and apparatus which takes advantage of the high speed response of Kuehnle U.S. Pat. No. 4,025,339 electrophotographic member using a flat-bed machine having plural toning stations sequentially arranged linearly along a framework. A color separated transparency was mounted on a copyboard and presented to a charged electrophotographic member. The charged member and the transparency were superposed and exposed to a light source. The carrier for the electrophotographic member was manipulated (pivotally inverted) and presented to a movable toning station. The toned member was again inverted for presentation to a transfer means effective to transfer the toned image to a sheet of print stock. The process could be repeated with different separations and toners with registration being obtained by positioning both color separation and electrophotographic medium with registration means provided.

The referenced patent applications disclose and claim a method and apparatus constituting improvements over the state of the art in respect of producing color proofs, including multiple color proofs, as represented both by the above-identified processes and the referenced patent.

Among the advantages, once mounted, the color separation transparency, the imaging member, or any other process related member need not be touched or manipulated so that the sequence of processing steps was capable of proceeding serially and automatically with a minimization of manually operated steps; daylight operational conditions, improvement in control and fine adjustment of background density and/or fog, on-line cleaning, discharge of any residual charge of the electrophotographic member subsequent to transfer and additionally reduces fabrication cost by substantially eliminating high precision components.

In the course of operating the system of the latest copending referenced patent application, a carriage carrying a platen on which an electrophotographic member having a photoconductive surface facing outward, is translated along a linear path past plural functional stations including a charging station, an imaging or exposure station, a toning station, an image transfer station and a cleaning station sequentially, the path being defined in a single horizontal plane by guide means mounted on a framework within a housing. A copyboard is located within said housing at the imaging station and means are provided for mounting a selected transparency thereupon. A toning module is located within the housing, said toning module including a sump containing liquid toner, a generally planar development electrode and means for flowing liquid toner generally uniformly across the development electrode. The toning module preferably is seated at one level normally and is lifted to a second level to place the development electrode in toning proximity with the photoconductive surface of the electrophotographic member when the carriage carrying same arrives at the toning station. The translation of the carriage begins at a home station, preferably the imaging station, and the carriage is translated past a corona generating device at the charging station for application of an electrostatic charge potential to the photoconductive surface of the electrophotographic member carried thereby. After sufficient charge has been applied to said surface, the carriage is translated to the imaging station where the copyboard is raised to establish an intimate engagement with the charged photoconductive surface and radiant energy from a source thereof located below the copyboard is projected to the photoconductive surface through the transparency. Then the copyboard is lowered. A latent electrostatic charge image thus is formed on said surface. The carriage then is translated to the toning station where the toning module has been lifted. Preferably, the toning module is raised to a level to be intercepted by the carriage, and particularly the platen, carried thereby. Resiliently biased slide means provided on the toning module adjacent the development electrode are intercepted by the entry of the platen into the toning station and forced downward against said bias whereby to establish a predetermined toning gap between the development electrode and the photoconductive surface during the passage of the surface through the toning station, the platen riding on said slide means.

One to three or more passes are made before the carriage leaves the toning station to enter the transfer station. At the transfer station, a receptor sheet, such as printing stock, is mounted on a suitable mounting, wetted with an insulating liquid medium, such as a liquid hydrocarbon, e.g., ISOPAR, and roller means are employed to effect transfer of the image to the receptor surface.

The different color toner liquids are carried individually in separate toner modules (containers) respectively, a different color separation transparency being substituted sequentially with the formation of a toner image from each transparency and transfer of the said toner image immediately after its formation. Only one toner image is formed at a time on the electrophotographic member. This toner image is transferred after formation by bringing the electrophotographic member to a transfer station whereat the toner image carried thereon is transferred to a receptor sheet. The member is returned for recycling employing the next in a series of color separation transparencies. Each toner image is transferred successively after formation in superimposed relationship on earlier toner images of the series one after the other on the receptor sheet in registration.

It would be of considerable advantage to eliminate preparing each separate color image on the electrophotographic member and transferring each sequentially in four separate operations while maintaining the required degree of registration on the receptor to form a composite color image thereon. However, it would be anticipated that considerable difficulties would be encountered in charging and toning of each existing toner layer which in turn, would interfere with the achievement of the desired result.

The extension of multicolor electrophotographic imaging technique to on-site oil well logging, seismic tracing, as well as other areas where a major drawback has been the vast quantity of recording paper generated in such fields, could be expected if the requirement of time and multiple proof copies can be eliminated. If the quantity of paper can be reduced as by a one step transfer process, feasibility of electrophotographic imaging would be enhanced materially.

SUMMARY OF THE INVENTION

A method for electrophotographic multicolor imaging in which multiple color toner images are formed one at a time sequentially superimposed one on the other of the successively applied toner images on the photoconductive surface of a single electrophotographic medium, each toner image being dried before an overall charge potential is applied to the surface, including the previously deposited dry toner image. The whole composite image when completed is transferred as a unit to a receptor medium in a single transfer step.

DESCRIPTION OF THE PREFERRED EMBODIMENTS

Figure 1:
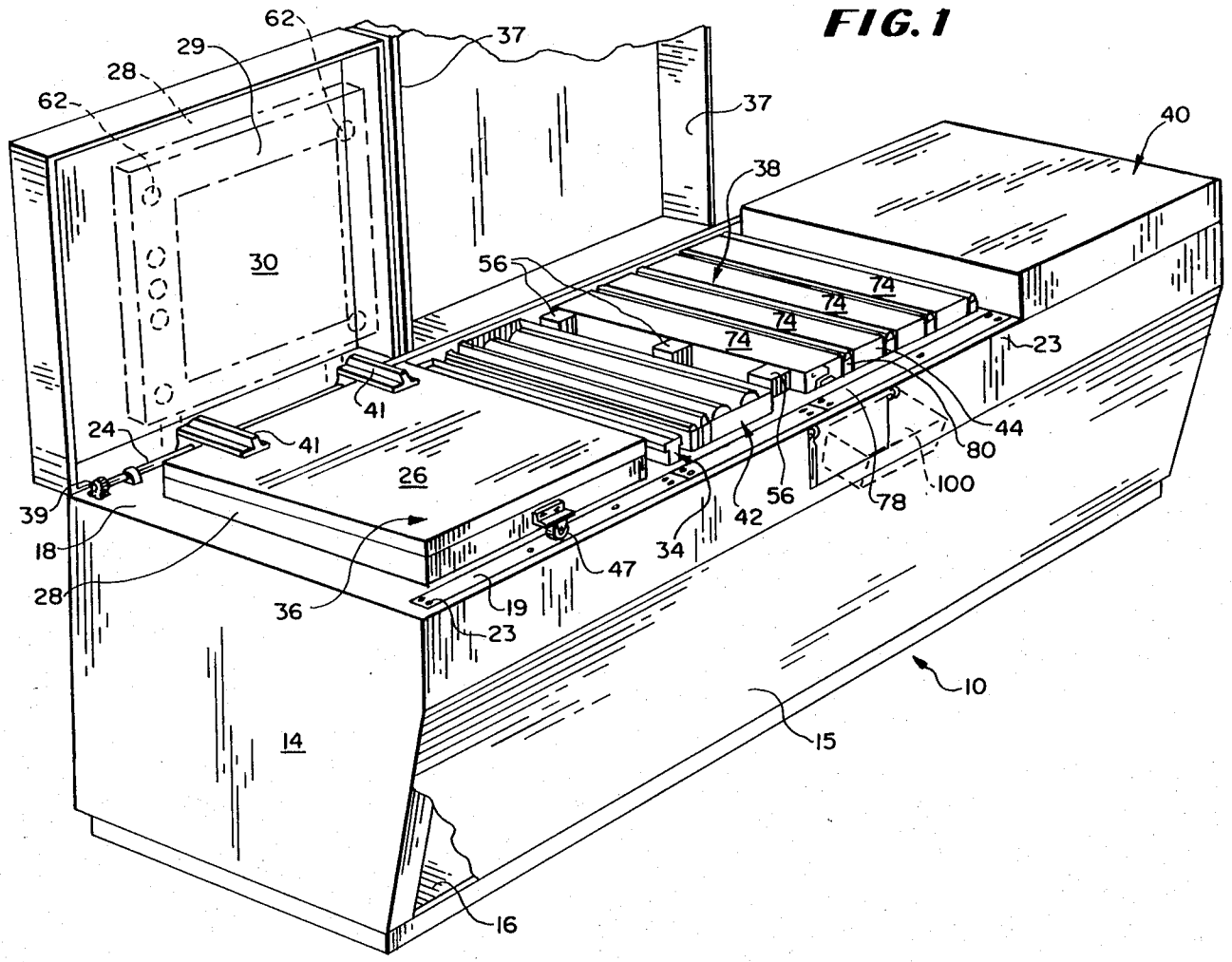
FIGS. 1 and 2 are a perspective and a side elevational view respectively, of a color proofing machine suitable for practicing the method of the invention.

In U.S. Pat. Nos. 4,025,339 and 4,269,919 there is described an electrophotographic recording medium, one form of which is a film whose qualities and properties make it far superior to any other known electrophotographic film. The electrophotographic film disclosed in those patents feature a photoconductive coating that is wholly inorganic, microcrystalline electrically anisotropic in nature, which does not have reciprocity or intermittency effects, operates at low voltages, has very high sensitivity and can produce toned images of exceptionally high quality from either analog or digital information. The photoconductive coating preferably comprises a layer of RF sputtered cadmium sulfide having a thickness of the order of 3,000 to 10,000 Angstroms. Because of its exceptional properties, the electrophotographic film is particularly suited for use in making high resolution color copies of color originals by electrostatic techniques and, in fact, has properties which enable it to be used for this purpose in a manner that hitherto has not been achievable with other types of electrophotographic members.

An important one of such exceptional properties is its full dischargeability, i.e. the charged photoconductive coating surface can be discharged to "zero" voltage. This property enables a uniform charge potential to be reapplied to the overall surface even subsequent to drying of a previously applied toner image thereon. The drying of the toner particles initially attracted to the photoconductive surface by the electrostatic field effectively electrically deadens the particles. Further, the electric field emanating from the said photoconductive surface is greater than 10 volts per cm, the particles, which particles are thus electrically deadenable remaining adherent even after the electric field is removed. The field is so intense that it extends through the discharged or electrically dead toner particles just as if there were no particles present, enabling the subsequently applied charge to be uniform over both toned and untoned areas, the toned areas carrying the charged on the trapping layer not on its surface. The toner particles are deposited during toning in layers thin enough to have a degree of transparency enabling the radiation (light) to penetrate through the layers of electrically "dead" toner particles of the previous toner image layer or layers.

Because of the high speed of response of said coating (capable of being exposed in nanoseconds), the invention can be embodied in a relatively high-speed machine to provide color prints much faster than heretofore possible.

Starting out with a color separated film original, one known process employs a master paper which carries thereupon an electrophotographic coating having photoconductive properties. The master paper is positioned on a platen employing register pins or the like, said platen being part of an electrostatic charging unit. An electrostatic charge is applied uniformly over the entire surface of the master paper. The separation film is placed in proper registry on the charged electrophotographic member and exposed to light, the non-imaged area discharged and the charge being retained in the imaged areas to define an electrostatic latent image. The master sheet is developed with toner of the proper color. After rinsing following development, the toned master sheet is removed from the charging and exposing apparatus and introduced into a separate multiroller transfer unit for transfer of the toned image to a substrate. The transfer normally is effected by first transferring the image to a cylindrical surface electrostatically and thereafter, from the cylindrical surface to the substrate. A separate drying unit is provided for evenly and thoroughly drying the proof sheet after completing each color cycle.

Figure 2:
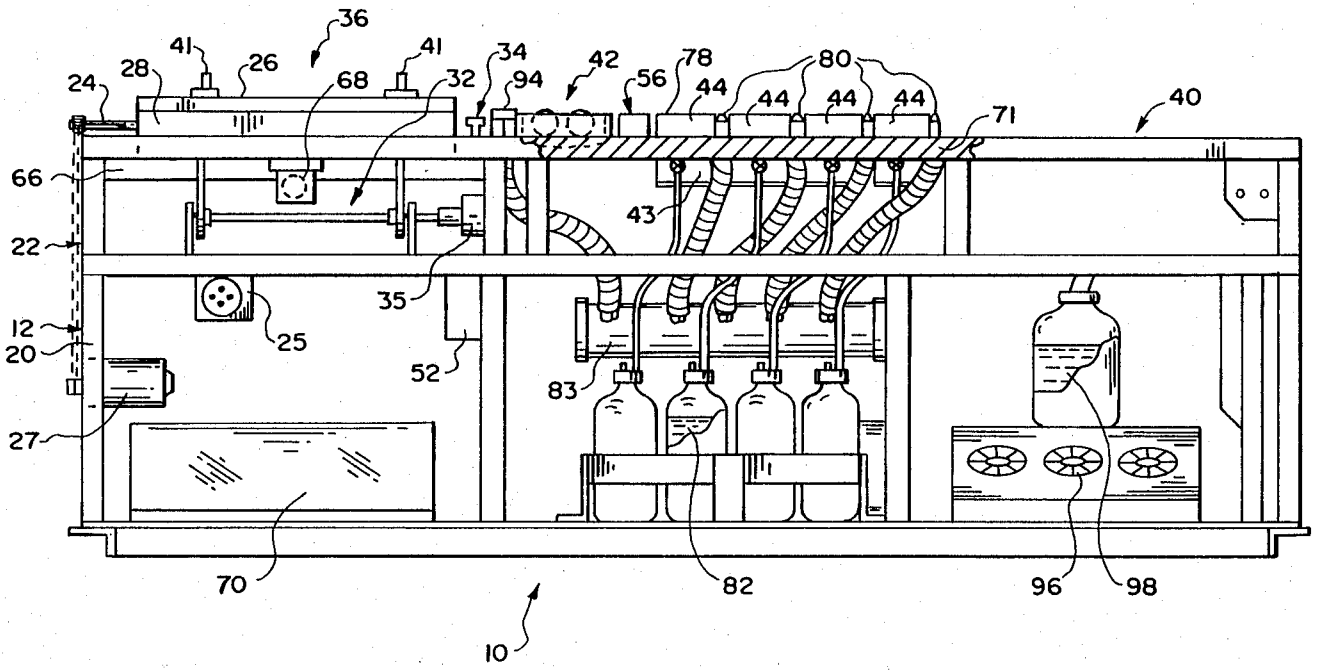

Attention is directed to FIGS. 1 and 2 of the drawing wherein is illustrated apparatus useful for carrying out the method of the invention as described hereinafter. Reference also concurrently is made to FIGS. 3 and 4 wherein a flow diagram of the operation of said apparatus is detailed, same being useful in describing the method of the invention.

Figures 3, 4:
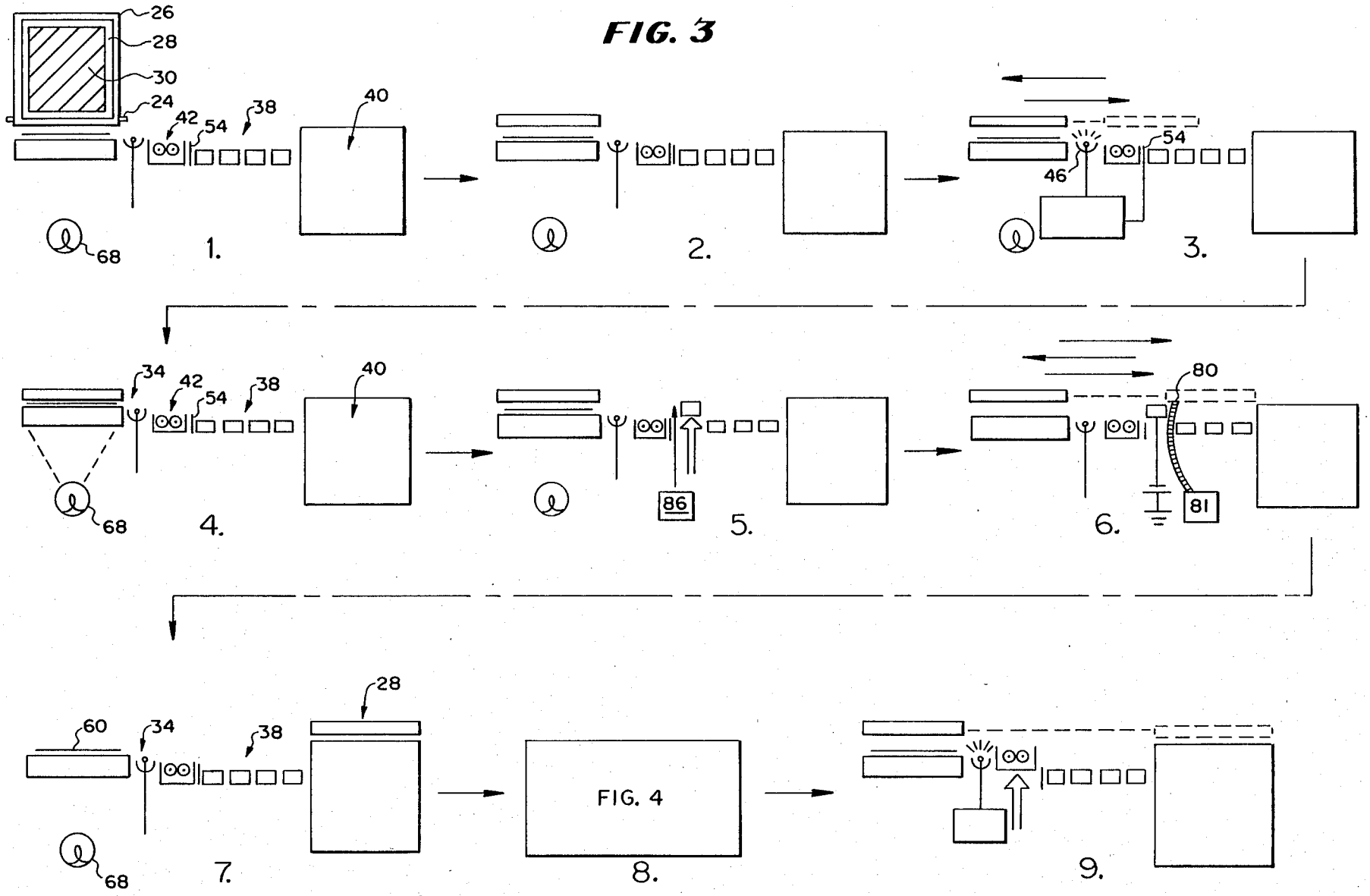
FIGS. 3 and 4 together comprise a diagrammatic flow representation of the method according to the invention.
Figure 4:
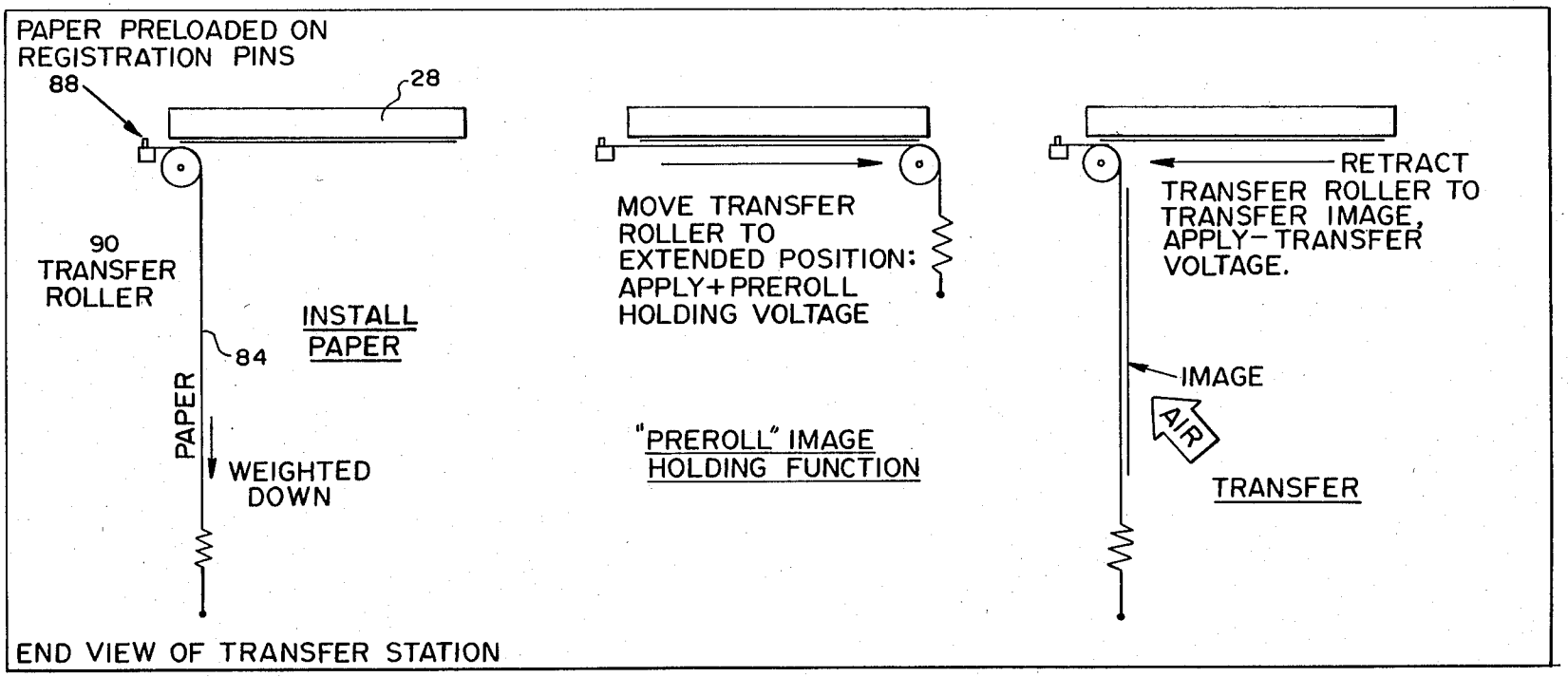

The method of the invention herein comprises the steps of sequentially imaging a series of color separation transparencies using the apparatus such as illustrated in FIG. 1 and in accordance with the flow diagram of FIGS. 3 and 4, said FIGURES being common with referenced application Ser. No. 348,769 as is the description of said FIGURES following.

Referring to FIGS. 1 and 2 inclusive, an electrophotographic imaging machine 10 employed in practicing the method of the herein invention is illustrated as having a generally open, box-like framework formed of robust steel structural members 20 mounting panel members to form a light-tight housing 12. Housing 12 has opposite end walls 14, opposite side walls 15 and a base 16. A rectangular top frame 18 completes the housing 12. The functional or processing stations required for the electrophotographic processing are disposed within the interior of the housing 12 and include an imaging or exposure station 36, a charging station 34, a toning station 38, an image transfer station 40 and a cleaning station 42.

The carriage 26 has generally rectangular configuration and a platen 28 having a planar electrophotographic member-receiving surface 29 faces outwardly of the carriage 26. A guide rail 24 is journalled in opposite blocks 39 secured on the top frame 18 at opposite ends of the housing and extending along the length of the frame 18. A track 19 is secured along the opposite side of the top frame 18, also extending along the length of the same. Swingable closures 37 also are mounted on the top frame, each capable of seating upon the top frame 18 to define a light-tight relationship with the housing 12.

The housing 12 includes a subchassis mounted in the upper portion thereof, the subchassis being designated as 22 in FIG. 2. The subchassis 22 carries the top frame 18 and rail 24. Alignment compensation shims 23 are used to adjust and set the desired horizontal planar orientation of the platen. The carriage 26 is driven through sprocket and chain by motor 25 and motor 27. The speed of translation can be varied in the range of one to eight inches per second.

The carriage 26 is disposed in a generally horizontal planar orientation during translation along rail 24 and track 19 over the functional stations driven through sprocket and chain by motor 27. The carriage 26 is driven through sprocket and chain by motor 25 enabling a generally vertical planar orientation of the carriage 26 so that an electrophotographic member 30 conveniently can be installed onto the platen 28.

The couplings 41 are capable of being slidably moved along the rail 24 carrying therewith the carriage 26 and platen 28. A wheel 47 is mounted on the carriage and ride on track 19 during motion of the carriage 26.

The platen 28 is mounted on carriage 26 with the carriage 26 mounted to rail 24 by hinged couplings 41. The electrophotographic member 30 has the photoconductive coating 31 (of the type disclosed in U.S. Pat. Nos. 4,025,339 and 4,269,919) sputter-deposited on a conductive substrate secured onto the platen 28 by a vacuum force suppled by vacuum pump 81 and magnetic discs 33 provide ancillary support that prevent release of the downwardly facing electrophotographic member 30 in the event of vacuum loss, such as during normal shutdown. The electrophotographic member 30 also may be restrained from accidental release by clamping or adhesive means (not shown).

Copyboard module 32, shown in FIG. 2, is located under the home position of platen 28 within subchassis 22. Module 32 will be described hereinafter when the imaging station is considered.

Referring to FIG. 3, the charging station 34 is provided with a corona charging device. Electrostatic sensors such as electrometers 56 are arranged across the path taken by carriage 36.

A high voltage power supply 52 can provide either positive or negative voltage and is switchably connected to the corona charging device to cause a substantially uniform and parallel corona cloud to be produced at station 34. As the carriage 26 moves in a linear path along track 19 and rail 26, the photoconductive surface 31 is transported over the corona field and the electrometer sensors 56 at a predtermined distance therefrom. The electrometer sensor 56 measures the charge residing on the photoconductive surface 31. This measurement is provided as a meter reading. Feedback control responsive to said electrometer sensors 56 may be provided to the corona power supply circuit (not specifically illustrated) to assure that a proper uniform level of charge is applied to the photoconductive surface 31.

The polarity of the charge potential applied to the photoconductive surface 31 herein for imaging normally is negative as the photoconductive material of the electrophotographic member 30 is an n-type semiconductor, namely, cadmium sulfide.

Accordingly, when the carriage 26 is translated past the corona charging station 45 in a first full pass, a positive polarity corona can be generated fully to discharge the surface 31.

The carriage 26 then is returned to the home position at the imaging station 36. During the return translation, the polarity of the corona discharge is reversed so that the charge potential applied to the surface 31 is of negative polarity. This change in polarity is effected by changing the polarity of the current directed to the corona charging device.

At the imaging station 36, the downwardly facing charged photoconductive surface 31 of the electrophotographic member 30 is exposed to radiant energy through a color separated transparency 60 from an energy source through a projection system located within said imaging station and located below the said surface and transparency (FIG. 10).

The platen next is translated horizontally to the toning station where one of plural toning modules is raised to a level for toning the electrostatic latent image of the pattern carried by said transparency 60.

Toning is effected with the assistance of an electrical bias voltage and may require one or more passes of the platen past the selected toning module for each color.

As mentioned, the preferred embodiment of the machine invention is operable under "daylight" conditions enabled by hinged swingable closures or covers provided selectively for covering the top of the housing and thus assuring a light-tight environment.

After the photoconductive surface 31 has been charged to the magnitude desired, the carriage 26 is driven by motor 27 along the track and rail 19, 24, transporting the platen 28 over the copyboard 32 at the imaging station 36.

The copyboard 32 is provided with upstanding pins 64 at locations about the transparency-receiving surface thereof. Matching sockets 62 are formed on the electrophotographic member receiving face of the platen 28. The color-separation transparency 60 is provided with registration holes and is mounted on the copyboard 32 with the pins 64 engaged through the registration holes of said transparency.

When the photoconductive surface 31 of the electrophotographic member 30 has been charged to the magnitude level desired, and the platen 28 is returned to the imaging station 36, the copyboard 32 is raised to an elevated position where the transparency is sandwiched engaged between the said surface 31 and the face of the platen. The pins 64 are engaged within the sockets 62 to assure registration. A lift motor 35 is provided operably coupled to the copyboard 32 to lift the copyboard 32 to its elevated position. A vacuum is drawn between the copyboard 32 and electrophotographic member receiving surface 29 of the platen 28 so that the photoconductive surface 31 and the color separated transparency 60 sandwiched therebetween, is forced into an intimate engagement. A roller 66 is located within the copyboard assembly and below the transparency 60, said roller being arranged to be translated across the undersurface of the copyboard 32.

The roller 66 extends across the width of the copyboard 32 parallel thereto and rotates about its longitudinal axis as it is translated along the length thereof. The roller is arranged generally biased against the copyboard 32 to exert an upward directed force on transparency 60, thereby to remove any air trapped between the juxtaposed face of transparency 60 and the charged photoconductive surface 31.

A suitable folded type projection system, including radiant energy source 68 and mirror 70 is disposed at the imaging station 36 within the housing 12 and below the copyboard 32. A useful light source 68 can comprise a high intensity, compact filament lamp 68 such as a General Electric type 100 TB/ISC 100 watt lamp. The radiant energy source 68 light path is reflected by the mirror 70 to distribute effectively to the transparency 60. The source 68 is regulated to provide a predetermined amount of radiant energy.

Attention is now invited to FIGS. 3 and 4 wherein the imaging process is set forth diagrammatically for clarity.

In common with the operation of the apparatus 10 of Ser. No. 348,769, the operator desiring to make a print copy first would turn on the power and install an electrophotographic member 30 onto the platen 28, first raising the platen 28 to reach generally vertical position. The separate toning modules 44 of the toning station 38 have been loaded with the correct liquid toners 82 desired and the appropriate color separation transparency 60 is engaged on the registration pins 64 of copyboard 32. The transfer medium 84 is mounted onto the registration pins 88 at the transfer station 40. This is identified as step 1 of FIG. 3. The operator then lowers the platen 28. This is illustrated as step 2 in FIG. 3. The apparatus 10 is light sealed by the hinged closure 37 until the image transfer function for the selected toner color 82 has been initiated.

Step 3 of FIG. 3 illustrates the charging function. The platen 28 starts moving from its home position over the copyboard 32 to a second position over the toning station 38. The corona generating device is energized. A positive corona first is produced to discharge and thereby fully to ready the electrophotographic film 30 as the platen 28 is moved back to its home position. Next, the corona current polarity is reversed, becoming negative, and a negative corona is applied to surface 31 of member 30. The platen 28 normally makes two passes over the charging station 34 in a reciprocating manner to complete the charging of the photoconductive surface 31 to a predetermined (or desired) magnitude level. During the charging function, the platen 28 may travel for example, at a speed of four inches per second, giving a charging function time of thirteen seconds. The usual travel speed range is about one to eight inches per second.

Next, the imaging or exposing function occurs, for example, approximately nineteen seconds, as represented in step 4 of FIG. 3. The copyboard lift motor 35 then raises the copyboard structure 32 in position for intimate registered engagement of the copyboard and the transparency 60 with the platen 28. A vacuum is drawn effectively between the copyboard supporting transparency 60 and the platen face supporting the photoconductive surface 31.

A motor driven roller 66 mounted in the copyboard 32 serves to squeegee any physical separation (e.g., air bubbles) between the platen face including the electrophotographic member 30 and the transparency 60 surface facing the member. Roller 66 travels the length of transparency 60 reaching the opposite end thereof and retracts to the roller's starting position. Vacuum is drawn and the imaging light source 68 is energized projecting a predetermined amount of radiant energy to the engaged transparency 60 and photoconductive surface 31 for a predetermined duration. The electrophotographic member 30 now has a latent electrostatic image of the pattern carried by the transparency 60 on the exposed photoconductive surface 31. The normal exposure time is typically ten seconds, and can be adjustable over a range of one to ninety-nine seconds.

On completion of such imaging step, the vacuum between the platen 28 and the copyboard 32 is relieved to air and the copyboard 32 structure is retracted downward, away from the platen 28, releasing the platen 28 for lateral travel.

The toning function begins when a selected toner tray 44 is raised to an elevated position by lift motor 76. The selected bias voltage is applied to the platen 28 as a positive level appropriate for the selected color, usually on the order of two volts. Where flow is directional, a short time delay is required to allow time for the flow of toner 82 across development electrode 74. The photoconductive surface 31 is prewet with fluid 98, which aids in reducing fogging of the final image because the surface 31 is already wet before coming in contact with the toner thereby acting to lubricate the photoconductor surface as a virtual barrier to direct toner particle contact with the photoconductive surface. The platen 28 starts its travel to the toning station 38. Toning is provided with the first pass of the platen 28 over toning electrode 74 for the selected color, a second return pass, followed by a final forward third pass over the development electrode 74 as illustrated in step 6 of FIG. 3. Where cleaning of residual toner from the surface 31 is required, vacuum pump 81, usually in the form of a vacuum producing turbine similar to the type employed in a vacuum cleaner, is activated to provide a vacuum at vacuum nozzle 80 adjacent toner tray 44 to remove any excess unattached toner from the photoconductive surface 31. A squeegee (not shown) can be mounted on the platen 28 so that it may be lowered to contact the development electrode 74 on the last pass to remove toner 82 therefrom. In accordance with Ser. No. 348,769, the platen 28 was moved toward the image transfer station 32, at the speed of six inches per second (with toning completed) compared to about one and one-half inches per second during the toning function.

Step 8 of FIG. 3 represents the platen 28 in the transfer position 40. FIG. 4 shows this step. The color separated transparency 60 for the next color cycle can be installed at this time without raising the platen 28, which is at its other extreme of travel. The prewet mechanism 86 would be activated so that transfer medium 84, e.g. paper, is prewet with fluid 98. The registration pins 88 would be engaged with the registration sockets 62 in the electrophotographic member-supporting platen 28, a prewet slinger mechanism 86 or (a spray device) prewets the transfer medium 84. The transfer roller 90 is translated while preferably an electrical bias voltage predetermined for the selected color simultaneously is applied to effect transfer of the toned image to the wet medium 84. The transfer roller 90 is translated across the toner image carrying member. The transfer roller 90 retracts. No bias voltage is mandatory during the return of the transfer roller. Positive transfer bias is used first while negative bias is used for transfer, when same is effected.

The significant difference, however, between the invention and the earlier methods involves elimination of the transfer steps for each of the series of color toner images and in lieu thereof, drying the toner images, then bringing the dry toner images back to the charging station, recharging the entire surface to a predetermined surface charge potential, exposing the thus charged surface to the next in the color separation image series. The resulting latent electrostatic charge image is toned with the appropriate liquid toner. Thus the successive toner images are superimposed. The relationship of the appropriate members is not changed, hence registration is no problem.

Each of the series of individual color images successively sequentially is applied to the same recording member surface until the final or last of the selective series of images is completed. Then the completed multiple color composite toner image is transferred as a unit to an image receptor such as print paper or the like.

As an example of the preferred practice of the invention, the apparatus of FIG. 1 was operated using a charging current of about negative 305 microamperes. The platen carrying the electrophotographic plate recording member was translated at a rate of four inches per second to effect the application of an average surface charge (ASV) of 25 to 30 volts.

The exposure step was effected using a light source comprising one 100 watt tungsten lamp, located at a distance of 5 feet from the photoconductive surface and equipped with a 480 nanometer broad band filter. A lens aperture of f8 was employed to apply actinic radiation to the engaged transparency and charged surface using a selected color separation negative transparency of a series corresponding to one of the series of color separations from the particular color toner to be applied.

The color toners correspond to the particular color separation, a proof print of which is desired, in the order of black, yellow, magenta and cyan.

After the surface 31 is charged and exposed to the black separation negative transparency, the resulting latent charge image is toned using the black toner.

The plate is then discharged using fluorescent room (ambient) light and the resulting image is permitted to dry by evaporation of the carrier of toner liquid dispersant either at room temperature or by heating or by vacuum.

When the black toner image is dry, the platen is returned to the charging station rather than to the transfer station. The toner image is permitted to remain undisturbed on the surface of said recording member. The next succeeding plate color image in the sequence, namely yellow, is obtained by recharging and reexposing the plate to the yellow separation negative and reimaging using the yellow toner. The plate once again is discharged and the yellow toner image allowed to dry in the same manner as previously described before proceeding to the next imaging cycle sequence. Accordingly, the charge, expose, tone and image drying steps are repeated two additional times to produce the magenta and cyan color images. The latter, in combination with the black and yellow images already present on the plate, yield the desired composite color image, ready to be transferred in one step to the selected receiving sheet as a full color image.

The photoconductive surface of the electrophotographic recording member is prewet prior to each toning pass, i.e. subsequent to the charging step. An electrical bias voltage of −2.00 volts is applied during each toning pass. The toning rate is selected as 1.5 inches per second. Each separate toner image is vacuum dried before the start of the following cycle.

The photoconductive surface of the recording member is exposed to fluorescent room lighting after each toning cycle to assure completion of the evaporation of any residual insulating liquid toner carrier (ISOPAR G) and hence provide at the close of the cycles, a totally dry four-color image for entry into the transfer station. Transfer is effected in the usual manner once the four color composite toner image has been completed.

Figure 5A:
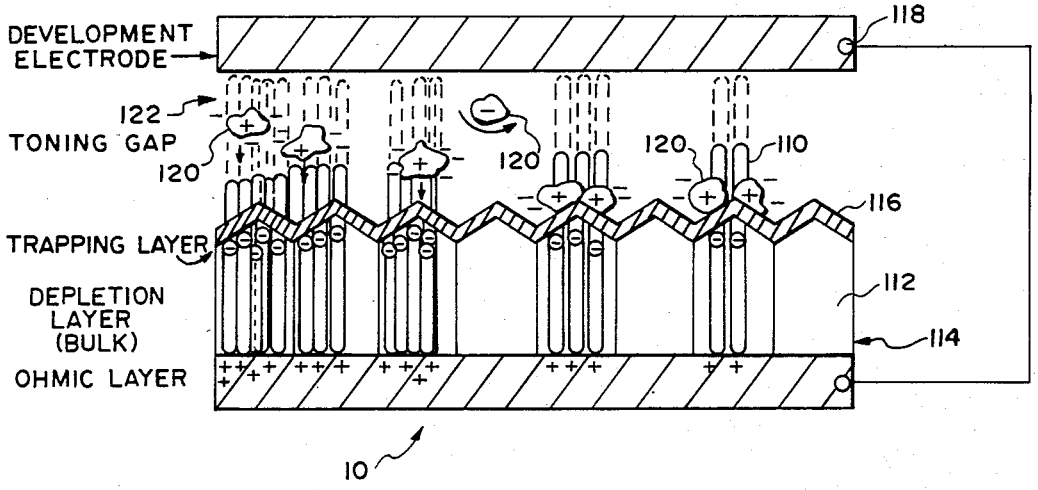
FIGS. 5A and 5B are graphic representations of the electrical field behavior of the electrophotographic recording member during the forming of the composite color toner image according to the invention, FIG. 5A illustrating the initial charging phenomenon, FIG. 5B illustrating the subsequent application of corona charged ions to the recording member carrying a previously deposited and dried color toner image thereon.
Figure 5B:
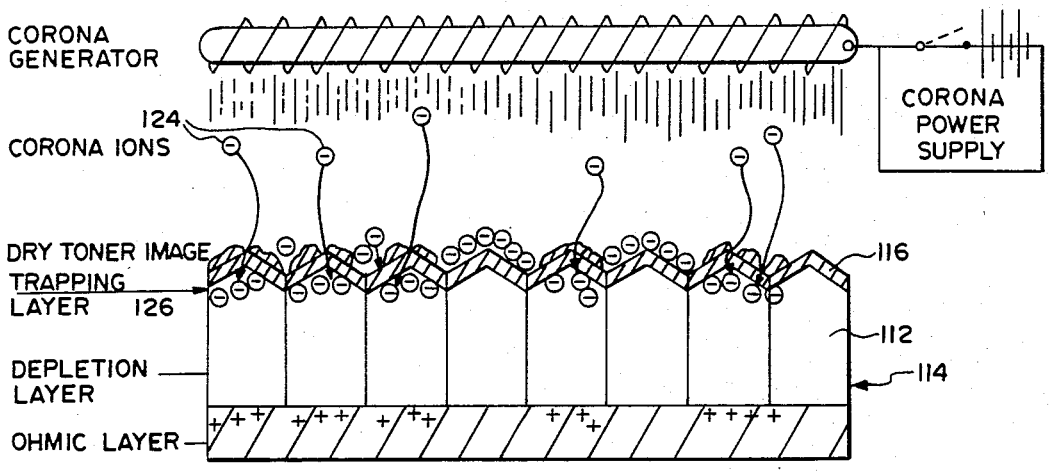

Referring to FIGS. 5A and 5B, the color imaging process according to the invention employs the general principles of electrophotography. Through the interaction of light with a previously charged photoconductor particularly described in respect of the photoconductive coatings disclosed in U.S. Pat. Nos. 4,025,339 and 4,269,919 a latent electrostatic charge image can be formed and made visible by the deposition of charged toner particles which are either attracted or repelled from the latent image in response to the direction of electric field lines, which comprise closed loops 110 extending lengthwise along the vertical axes of each crystallite 112 of the coating 114.

These lines or loops 110 protrude and exert a strong force above the photoconductor surface 116, and are intensified with the aid of a closely spaced development electrode 118. The loops (lines) extend across the gap when the development electrode is present. See broken line loops. Once the visible toner image has been formed it may be transferred under controlled conditions to an image receptor. The photoconductor is then readied to receive its next image.

The conditions under which the images are formed and transferred vary significantly from all other electrophotographic processes inasmuch as the surface voltage of the photoconductor, even in its maximum charged condition, is very low, e.g., one-tenth of the usual voltages, while the charge density is kept very high since a thin film photoconductor layer is employed. This layer 114 can sustain a field much stronger than other photoconductors. Charged toner particles 120 are attracted to the surface 116 with great effectiveness due to the high field intensity in the image areas and good particle mobility which the diluent provides in the toning gap 122. The high field—but low voltage—in turn demands close proximity of development electrode 118 in order to intensify the available field lines and cause the rapid deposition of the available toner particles. The closed gap, smaller than the usual development gaps, necessitates the use of fairly concentrated but very small submicron size toner particles to satisfy the need for high density image deposits in the short time allotted to the basic image formation process. The implementation of proper toning conditions with liquids which can be moved around predictably is substantially easier than the application of powder toners, which require elaborate transport and cleaning schemes and further which powders are not available in the sub-micron size needed.

A typical one of the patented photoconductor coatings can sustain a charged density of $$q = \frac{V_{\epsilon\epsilon} 0}{C} = 8 \times 10^{-7} \text{ coul/cm}^2 \quad (1)$$

which is based on a charge acceptance of 10 V/1000 Å with a photoconductor 3000 A thick and having a dielectric constant of eight. Using a nominal crystallite diameter of about 700 Å one gets to a charge density of 250 electrons per crystallite; this results in a field across the photoconductor of $$\phi = \frac{30}{3 \times 10} - 5 = 10^6 \text{ V/cm field strength.} \quad (2)$$

Since voltage is more radily measurable than field line densities, one can represent the toner particle deposition in relation to the voltage although, as stated above, the process employs the electric field to attract particles rather than "voltage". Nevertheless, in general terms, a 30 V film will attract in one second about 15 layers of toner patticles to form a transmission density of 3.0. Please note that the toner deposition process terminates when the field is saturated and force equilibrium is established.

A voltage of 20 volts could correspond to a nominal transmission density of 2.0, with lower densities represented by very low deposits of particles which, because of the low signal-to-noise ratio, electrically speaking, will still form recognizable images at contrast levels as low as 5%, and thus are able to capture information which would normally be lost in the fog level of other materials. Due to the electrical anisotropy of the patented crystal photoconductor, very high resolution can be maintained; even resolution of 1000 cycles/mm can be obtained.

The color toner particles, which are initially attracted by an electrostatic field, can be dried by an airstream (vacuum cleaner nozzle) without dislocation and will remain adherent in light even after the electrostatic field is gone.

The particles are electrically dead after the last mentioned events and cannot be revived when wetted, i.e., say with the electrically insulating liquid toner carrier such as ISOPAR TM during the next toner pass.

The next charging step will not "blow away" the dead particles (corona wind) but cause the charging ions emanating from the corona source to tunnel right through the previously deposited particles to reach the surface and be trapped in the photoconductor to form a uniform photoconductor charge in the untoned and toned areas. All the charging ions tunnel through the toner image so that the appplied charge lies below the toner imaged areas only, i.e. in the trapping layer. No charge lies on the toner image surface. Nevertheless, the charge overall and its field effects are uniform at the toned and nontoned areas.

The subsequent exposure radiation light penetrates the previously deposited particle layer sufficiently strongly to cause the discharge of the electronic charge even beneath a previous layer, and thus forms a correct latent electrostatic image undisturbed and unaffected by the previous particle layer.

Since there is no charge on the toned image areas, the field of the new electrostatic image formed under the second applied toner image reaches through the dead particles from the previous image to attract the next layer of color particles which are then superimposed onto the previous image without disturbing said previous layer of imagery.

It is believed that the property of the selected photoconductor being capable of discharge to "zero" voltage is a significant factor herein. The high intensity of the field emanating from the crystals of said photoconductor results in extension thereof through the dead particles to attract new particles. In exposure, the degree of transparency allows the light to penetrate through the dead particle layers.

FIG. 5B illustrates the behavior of the corona emitted charged ions 124 during the second charging step involving application of the charge to both the toned and untoned areas, the charged ions 124 tunnelling through said toner image to accumulate in the trapping layer 126.

For color image reproduction, particularly at the desired high quality levels, the above properties are of importance because color representation in terms of density on reflective substrates such as paper, for example, principally is related to area coverage rather than deposition height, i.e., density. Specifically speaking, in half-tone image reproduction such as offset printing, the visual density, for a given thickness of deposit, is strictly represented by the covered area which the eye interprets as an integrated density value. Thus, if the boundaries of individual dots cannot be controlled finely, the desired density effect may fluctuate widely because the image smear covers unintended print territory. Together with superimposed additional colors, such boundary fluctuation can and will cause shifts in chromaticity value and thereby affect the predictability of the image quality which one intends to achieve.

According to the process of the invention, a second or third or fourth layer of color toner should maintain the same edge acutance and resolution as the first layer. Further, the additional layers of color toner also abide by the field intensity forces emanating from the basic photoconductor without being attenuated by the first layer.

Accordingly, summarizing, the basic process is carried out in accordance with the herein invention, in a series of successive steps which begins with charging the photoconductor from a suitable corona source; irradiating the surface with an image pattern; choosing an intensity level for the exposure which discharges the photoconductor in the clear areas to zero; applying in the narrow toning gap, the desired first color toner particles which are inked out to saturation; drying the deposited layer to render the deposit electrically inactive permitting reestablishment of the field lines as the essential preconditon for the attraction of additonal particles of different color in the next imaging cycle.

After depositing multiple layers of the different successive color toner images, each of which may be in the form of color dots, which will largely vary area-wise but be grouped in such a manner as to achieve the desired color effect (one uses mostly secondary, that is, subtractive colors), one can achieve the hue, saturation, and luminescence values within a pixel area which characterize the quality of the prints and the wide dynamic range which are innate to this color imaging process.

The benefits of this color process reside in the ability to produce instant hard copy prints on plain paper.

The details of the method according to the invention may be modified as follows without departing from the spirit and scope of the invention as claimed herein:

(a) The charging current may be −400 microamperes.

(b) the lens aperture may be variable, controlled automatically by a light integrating device.

(c) A white unfiltered light source such as a 100 watt diffuser equipped bulb located about 5 ft. from the photoconductive surface; the exposure time, for screened images, 6–8 seconds, for continuous image, 2 seconds.

(d) The order of colors may be changed, notably, black, magenta, cyan and yellow;

(e) The bias voltages may differ from color to color—black and yellow, +2.0 V; magenta +2.5 V and cyan (+3.00 V);

(f) The toning rate may be varied, for example, 1.3. inches per second instead of 1.5 inches per second described earlier.

Transfer, when made, also may be effected to an image receptor formed in accordance with the teachings of copending patent application Ser. No. 423,014. Using such image receptor, the imaged recording member first is heated to about 125° C. on a platen which comprises a smooth surface aluminum block of a size corresponding to that of the recording member. The image receptor with its heat softenable surface layer facing the toner image on said recording member. The receptor sheet is laminated to the recording member by means of a one inch diameter hard rubber roller. The roller is press-rolled across the uncoated side of the receptor sheet in one continuous motion at a rate of approximately 2 to 5 inches per second. The recording member and receptor sheet then are separated with the composite image being retained completely on the image receptor sheet. A heated stainless steel roller may be used in lieu of the rubber roller; however, the recording member carrying the composite image can be maintained at ambient temperature.

When transferred, each of the toner images is transparentized, generally via the process of transfer to the image receiving layer of the receptor medium.

Many variations are capable of being made without departing from the spirit or scope of the invention as defined in the appended claims.

What is claimed and desired to be secured by Letters Patent of the United States is:

1. A process of electrophotographic multiple color imaging comprising forming superimposed plural toner images one at a time in sequential order in registry on the photoconductive surface of a uniform microcrystalline wholly inorganic photoconductive coating of an electrophotographic medium to form a composite of superimposed toner images and transferring said of toner images to an image receptor medium to form a superimposed color composite image pattern in registry, the individual toner images being formed successively one at a time from electrically deadenable liquid toner, the images being superimposed on said electrophotographic medium, electrically deadening each color toner image by drying same after formation and before formation of a successive image, exposing each of the dried color toner images and the nonimaged areas of the photoconductive surface to corona originated charged ions subsequent to drying said prior deposited toner image permitting said ions to pass through said electrically deadened dried color toner image or images to thereby apply a uniform overall charge to the photoconductive coating juxtaposed both the dried color toner image-containing areas and the nonimaged areas of the surface of the photoconductive coating, exposing the said charged surfaces to a second color pattern from a source thereof to form a latent charge image of the second color image pattern superimposed on the electrically deadened first toner image, applying a second color electrically deadenable liquid toner corresponding to the second color pattern to the second latent charge image to form a second color toner image superimposed on the first color toner image and repeating the steps of drying, charging, exposing, toning and drying until the desired color composite toner image is formed and transferring the thus produced composite of superimposed toner images to a receptor medium in a single transfer step.

2. The method as claimed in claim 1 and the step of applying an electrical bias voltage during each toning step.

3. A method for making color proofs electrophotographically from color separated positive transparencies, comprising the steps of:

A. loading a color separated positive transparency on a copyboard,

B. applying a charge potential upon the photoconductive coating of a horizontally disposed electrophotographic member, C. establishing an intimate engagement of said copyboard and charged coating, D. exposing said engaged copyboard and charged coating to a light source to form a latent electrostatic image of the transparency, E. applying an electrically deadenable toner comprising insulating liquid toner carrier to said latent image by translating a development device across said coating, F. drying the resulting developed image by removing any remaining insulating liquid to render the developed image electrically dead, repeating the charging steps A, B, C, D, and F on the same photoconductive coating, substituting each of a series of plural different color patterns from a source thereat sequentially whereby to form plural superimposed color toner images one on the other on the same photoconductive coating until a composite of superimposed color toner images representing the composite of said color separation series is formed for transfer as a unit, the charge applied in the repeating of step B being applied uniformly to the photoconductive coating juxtaposed both toned and nontoned areas of the surface of the photoconductive coating with the charged ions passing through the toner imaged portions to reach the photoconductive surface, bringing the recording member carrying the superimposed composite toner images and an image receptor medium into transfer proximity and transferring the composite toner image from said recording member as a unit to the image receptor.

4. The method as claimed in claim 3 and the step of varying the magnitude of the electrical bias applied with application of each color toner.

5. A process of electrophotographic color imaging comprising the steps of providing an electrophotographic recording member having an outwardly facing uniform microcrystalline wholly inorganic photoconductive coating capable of being charged from a corona source to a predetermined surface charge potential and discharged by exposure to radiation image pattern from a source thereof to form a latent electrostatic charge image of said pattern, the photoconductive surface being capable of being discharged to virtual zero potential at the clear areas of the pattern, charging the photoconductive surface from the corona source to apply a uniform overall surface charge potential thereto, irradiating the charged photoconductive surface with the radiation image pattern from a source thereof toning the resulting latent electrostatic charge image of said pattern by application thereto of a first electrically deadenable color liquid toner particle suspension to form a visible first color toner image thereon, drying the first deposited first color toner image after formation and before formation of a successive toner image to render the said deposit electrically inactive whereby to permit reestablishment of electrical field lines through the imaged areas of the recording member to thereby enable applying a uniform overall charge to the photoconductor coating thereby enabling attraction of additonal toner particles by virtue of the charge image on the photoconductive coating upon subsequent charging exposure image pattern irradiation and toning.

repeating the charging, image pattern irradiation, toning and drying steps successively sequentially using different color image patterns and different electrically deadenable color liquid toner particle suspensions to form superimposed color toner images in layers onto the photoconductive surface or previously deposited color toner image and images thereby forming a composite color toner image, omitting the drying of the last to be applied color toner image, and transferring the resulting composite color toner image intact to an image receptor.

6. The process as claimed in claim 5 and the step of transparentizing the toned image on the image receptor.

* * * * *